US008186295B2

(12) United States Patent
Fournier

(10) Patent No.: US 8,186,295 B2
(45) Date of Patent: May 29, 2012

(54) SUBMARINE PROVIDED WITH A DEVICE FOR RELEASING AND RECOVERING A SECONDARY UNDERWATER VEHICLE

(75) Inventor: Jean-Claude Fournier, Gassin (FR)

(73) Assignee: DCNX, Paris (FR)

( * ) Notice: Subject to any disclaimer, the term of this patent is extended or adjusted under 35 U.S.C. 154(b) by 14 days.

(21) Appl. No.: 12/665,525

(22) PCT Filed: Jun. 9, 2008

(86) PCT No.: PCT/FR2008/051024

§ 371 (c)(1),
(2), (4) Date: Mar. 15, 2010

(87) PCT Pub. No.: WO2009/004209

PCT Pub. Date: Jan. 8, 2009

(65) Prior Publication Data

US 2010/0192831 A1 Aug. 5, 2010

(30) Foreign Application Priority Data

Jun. 19, 2007 (FR) ..... 07 55854

(51) Int. Cl.
*B63G 8/00* (2006.01)

(52) U.S. Cl. ..... 114/332

(58) Field of Classification Search ..... 114/312, 114/316, 322

See application file for complete search history.

(56) References Cited

U.S. PATENT DOCUMENTS

| | | | | |
|---|---|---|---|---|
| 3,034,471 | A * | 5/1962 | Aschinger | 114/244 |
| 3,757,722 | A * | 9/1973 | Seiple | 114/322 |
| 3,943,875 | A | 3/1976 | Sanders | |
| 5,253,605 | A | 10/1993 | Collins | |
| 5,642,330 | A * | 6/1997 | Santopietro | 114/244 |
| 6,600,695 | B1 | 7/2003 | Nugent et al. | |
| 7,798,086 | B2 * | 9/2010 | Ruggaber | 114/322 |

FOREIGN PATENT DOCUMENTS

| | | |
|---|---|---|
| DE | 41 40 201 | 6/1993 |
| EP | 1 507 311 | 2/2005 |

OTHER PUBLICATIONS

International Search Report dated Jan. 23, 2009, from corresponding PCT application.

* cited by examiner

*Primary Examiner* — Lars A Olson
(74) *Attorney, Agent, or Firm* — Young & Thompson

(57) ABSTRACT

A submarine (1) includes a bridge (4), a bridge fin (3) and a device (8) for releasing and recovering a secondary self-propelled underwater vehicle (90). The device (8) includes a handling element (8A) which can be used to move the secondary underwater vehicle between a storage zone (18) and a release or recovery zone (19) and a reversible grip element (14) solidly connected to the handling element (8A), which can be used to free the secondary underwater vehicle (90) at the moment of release and to attach the vehicle at the moment of recovery. The release and recovery device (8) is designed such that the release and recovery zone is located outside the turbulent zone (7) that surrounds the moving submarine.

18 Claims, 3 Drawing Sheets

SUBMARINE PROVIDED WITH A DEVICE FOR RELEASING AND RECOVERING A SECONDARY UNDERWATER VEHICLE

This invention relates to a device for releasing and recovering a secondary self-propelled submarine vehicle from a vessel, and in particular from a submarine when submerged.

Military submarines often transport secondary self-propelled underwater vehicles which they have to release and recover. The self-propelled vehicles may be manned vehicles or remote-controlled vehicles or entirely automatic vehicles. These vehicles have a variety of uses which are known to those skilled in the art. Release or recovery of the secondary underwater vehicles is generally difficult. Release generally takes place from a caisson located on a side of the hull of the submarine, using divers, under conditions that are somewhat unsafe. Recovery generally takes place close to the surface, and this imposes considerable operational constraints. It has also been envisaged that these secondary underwater vehicles should be released or recovered at the bow of submarines using devices comparable to torpedo tubes. These methods are difficult to implement and give rise to risks of collision between the submarine and the secondary underwater vehicle.

Submarines which include piloted rescue submarines attached to the deck on supports are also known. But these rescue submarines can only be released or recovered with very great difficulty when the carrying submarine is under way. Effectively they can only be used under exceptional conditions.

The object of this invention is to overcome these disadvantages by providing means whereby a submarine can release and recover a secondary underwater vehicle when submerged without the involvement of divers and without leaving its working depth, under satisfactorily safe conditions.

For this purpose the invention relates to a submarine of the type comprising a fin and possibly a raised deck, and comprising a device for the release and recovery of a secondary self-propelled underwater vehicle, the release and recovery device comprising handling means through which the secondary underwater vehicle can be moved between a storage zone and a release or recovery zone and reversible docking means, of one piece with the handling means, which can release the secondary underwater vehicle at the time of release and hook onto the secondary underwater vehicle at the time of recovery, designed so that the zone for release or recovery is located outside the zone of turbulence surrounding the submarine when the latter is under way.

Preferably the release and recovery device is mounted at the upper after end of the submarine's fin and the handling means can be located in a resting position in which it constitutes the trailing edge of the fin.

Preferably the handling means comprises a handling arm of which one free extremity can move between a storage position and a release or recovery position and the handling arm is mounted on a support provided on the upper after part of the fin by means of a joint allowing the arm to pivot around a transverse axis with respect to the arm.

Preferably the handling means comprises a device for immobilising the secondary underwater vehicle mounted on the free extremity of the handling arm and means for manoeuvering the handling arm and the docking device.

The immobilising device comprises, for example, at least a clamp or a cage.

Preferably the immobilising means is mounted at the extremity of the handling arm by means which are designed to control the orientation of the axis of the secondary underwater vehicle at least in the release position and, for example, to hold it parallel to the longitudinal axis of the submarine at all times.

The docking device for example comprises a docking bell comprising means for joining and reversibly locking the docking bell and the bow of the secondary underwater vehicle together, and means for guiding a secondary underwater vehicle.

The means for reversibly joining and locking the docking bell and the bow of a secondary underwater vehicle together may comprise a pump which draws water from within the bell and/or delivers water into the bell.

The means for reversibly joining and locking the docking bell and the bow of a secondary underwater vehicle together may comprise a hook moving between a hooking position and a release position and means for activating the hook and more generally any mechanical or magnetic locking means.

The guide means comprise for example one or more means of the acoustic transducer, optical beam or laser beam type.

Preferably the docking bell can move with respect to the free extremity of the handling arm and is connected to the handling arm by a cable wound onto a winch.

The docking bell may include a television camera and manoeuvering means connected to a control station located within the submarine.

When the submarine has a raised deck, the storage zone will for example be located on or beneath the deck and comprise a storage compartment which may include a pressure-resistant caisson.

The submarine according to the invention is in particular a submarine for military use.

This invention makes it possible to release and recover a secondary underwater vehicle from a parent submarine (or mother submarine) in safety with few operational constraints. In fact the invention makes it possible for these operations to be performed at a significant distance from the hull (ten or so metres), which limits the risks of collision, in particular with the propeller.

In addition it allows the secondary underwater vehicle to move stably outside the turbulence created by the hydrodynamic wake of the main submarine, which greatly eases recovery operations.

The invention will now be described more specifically but without limitation with reference to the appended figures in which.

Figure 1:
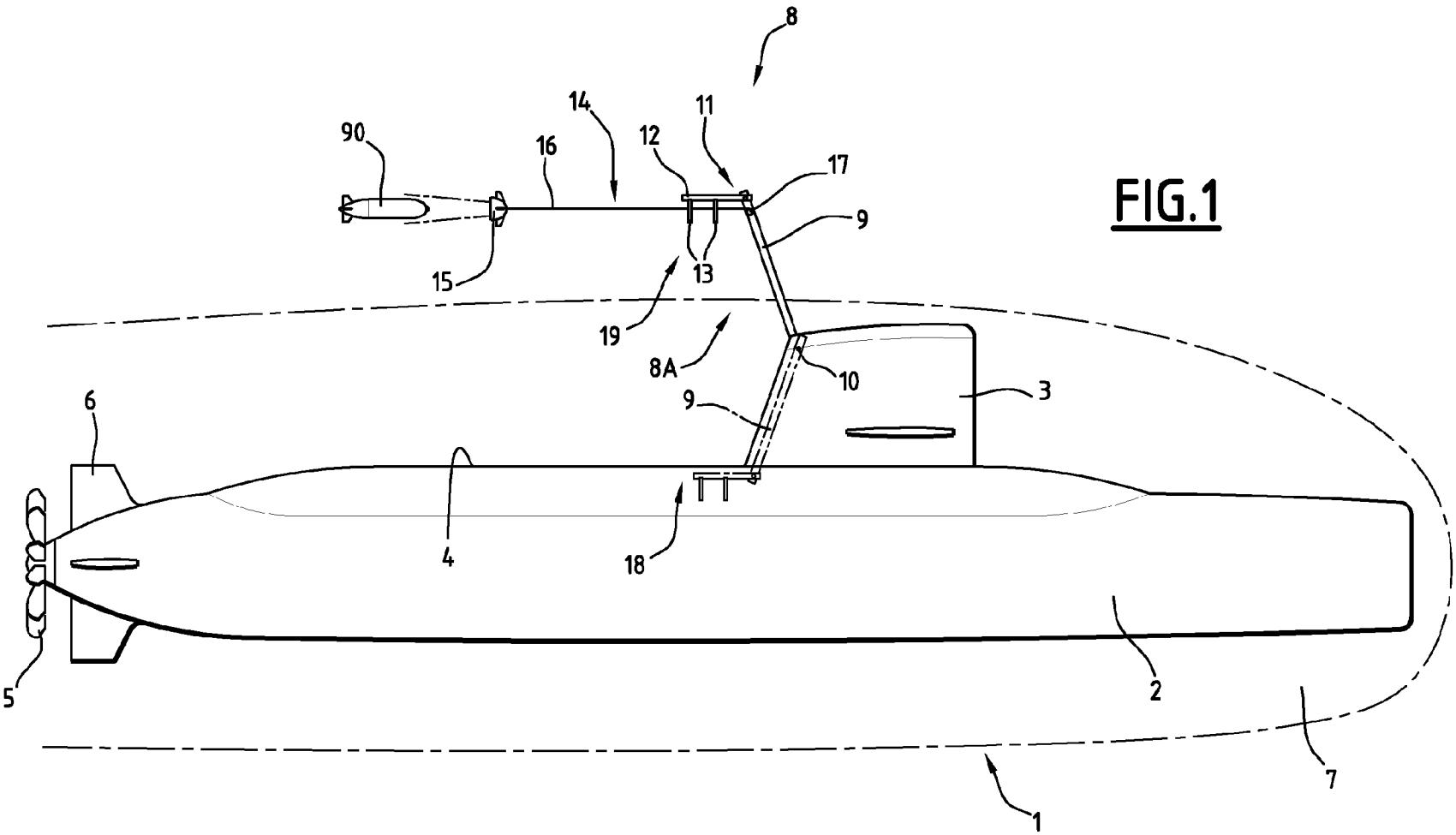
FIG. 1 is an overall view of a submarine equipped with a release and recovery device for a secondary underwater vehicle.

The submarine generally identified by 1 in FIG. 1 comprises in a manner which is itself known a hull 2 on which stand a fin 3 and a raised deck 4. Aft, the submarine comprises propulsion means 5 and guide planes 6. The submarine as shown in FIG. 1 is submerged, and is therefore under way. In fact it is effectively impossible for a submarine to remain stable when submerged without moving even relatively slowly. Because of this movement the submarine is surrounded by a zone of turbulence 7. Submarine 1 comprises on its top side a release and recovery device generally identified by 8 and designed to release or recover a secondary underwater vehicle 90. This device is designed so that means for docking with and securing the secondary underwater vehicle can be moved from a position in which the secondary underwater vehicle is stored to one in which it is released or recovered, located outside the zone of turbulence surrounding the vessel from or to which it is desired to release or recover the secondary underwater vehicle.

The release and recovery device comprises handling means generally identified by 8A comprising a handling arm 9 mounted and articulated at one of its extremities about a horizontal axis 10 located in the after upper corner of fin 3. Horizontal axis 10 is perpendicular to the longitudinal direction of the arm, so that the arm can be deployed by rotation about that axis. The free extremity 11 of handling arm 9 carries an immobilising device 12 comprising two clamps 13 fitted with operating means and designed to be able to grip a secondary underwater vehicle. It will be noted that the immobilising means may also be a cage or any other suitable device. The free extremity of the handling arm also carries reversible docking means generally identified by 14, comprising a docking bell 15 connected by a cable 16 to a winch 17 located at the extremity of handling arm 9. The handling arm can move between a position generally identified by 18, which is a position in which the secondary underwater vehicle is stored, and a position 19 in which secondary underwater vehicle 90 is released or recovered. Handling arm 9 is of sufficient length so that when in position to release or recover the secondary underwater vehicle the docking means is located outside the zone of turbulence 7 which surrounds the submarine when it is under way.

Figure 2:
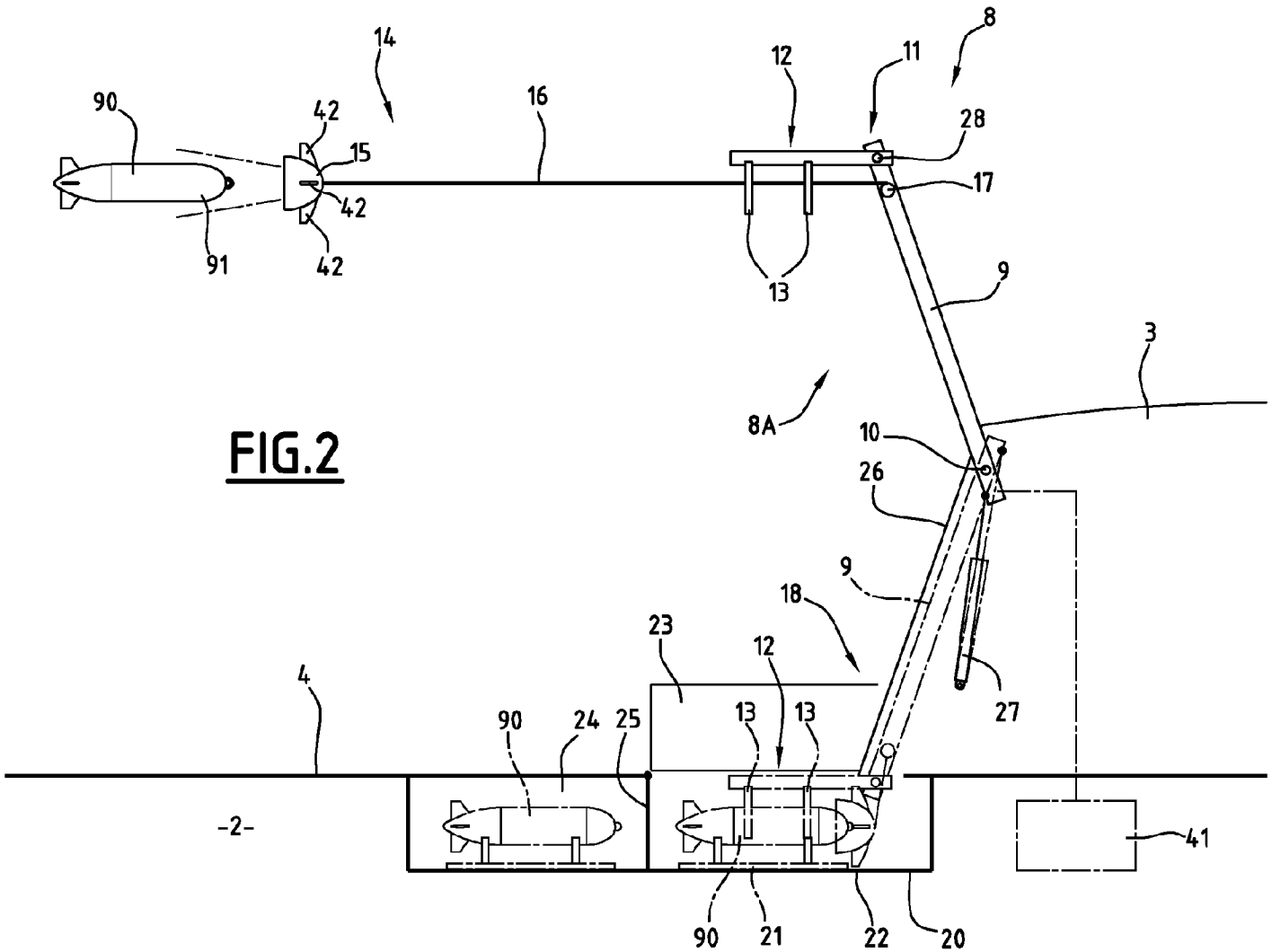
FIG. 2 is a magnified view of the device for release and recovery of a secondary underwater vehicle equipping the submarine in FIG. 1, and its location on the submarine.

As will be better seen in FIG. 2, when arm 9 is in the release or recovery position, i.e. its free extremity is in the release or recovery zone, immobilising device 12 is horizontal, that is to say parallel to the general axis of the submarine. When arm 9 is in the position for storage of the secondary underwater vehicle immobilising device 12 is also in a horizontal position so that it can deposit the secondary underwater vehicle horizontally within a storage compartment 20 located beneath raised deck 4. In this storage compartment 20 the secondary underwater vehicle is set down onto a receiving and transport cradle 21 which can move between a zone 22, which is closed off by a door 23 and is accessible from the exterior of the submarine, and a pressure-resistant caisson 24 separated from free zone 22 by a watertight door 25. When it is in the storage position arm 9 extends along the trailing edge 26 of fin 3.

The handling arm comprises means to operate it. These means are in particular a jack 27 for performing movements between the storage position and the release and recovery position, a rotating jack 28 which moves gripping device 12 in relation to arm 9 in such a way as to ensure that the gripping device is always in a horizontal position, and means not shown for operating clamps 13 of the gripping device. Other active or passive operating means may be used. Passive means may for example be of the parallelogram type. Those skilled in the art will be aware of such means.

Figure 3:
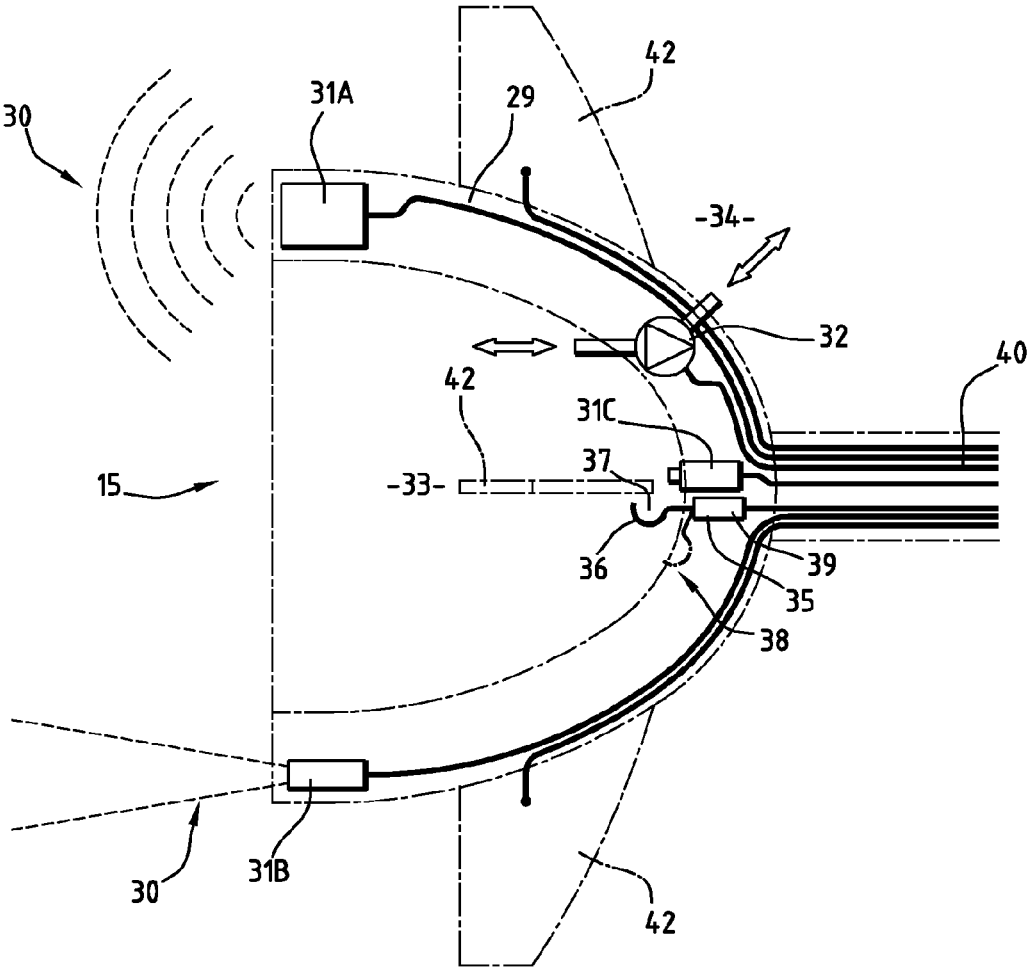
FIG. 3 is a diagrammatical view of a docking bell for a secondary underwater vehicle fitted to a device for the release and recovery of such a vehicle.

Docking bell 15 of the reversible gripping means illustrated more completely but diagrammatically in FIG. 3 comprises a fairing 29 having a shape matching the shape of the bow 91 of a secondary underwater vehicle. This bell comprises means generally identified by 30 for guiding the secondary underwater vehicle, comprising for example an acoustic transducer 31A and a normal light or laser light beam 31B.

This bell is also equipped with a reversible suction and delivery pump 32 through which water can be pumped within the interior 33 of the bell to discharge it to the exterior 34, or conversely is capable of pumping water to discharge it to the exterior 34, or conversely capable of pumping water from the exterior 34 of the bell and reinjecting it within the interior 33 of the bell. The bell also has means 35 to hook onto or release the bow of the secondary underwater vehicle. This reversible hooking means 35 comprises a hook 36 moving between a hooking position 37 and a release position 38. This hook is operated by operating means 39. The pump and the hook comprise means for reversibly attaching and locking together the bell and the secondary underwater vehicle. It will be noted that the bell may advantageously be replaced by any reversible mechanical or magnetic locking means. These means may for example be of the jaw, catch or pin type, as far as mechanical means are concerned, or of the electromagnetic type, or of the type with a permanent magnet coupled to an electromagnetic coil.

Those skilled in the art will be aware of such means.

In addition to this the docking bell may be fitted with a television camera 31*c*, associated for example with an optical beam, and a control system through which an operator located in the main submarine can perform the final approach by manoeuvering the bell around its position of hydrodynamic equilibrium. These control means may for example comprise small moving planes 42 or hydrodynamic jets.

The various items of equipment in the docking bell are connected by power and control cables 40 to a source of energy and a control station 41 located in the main submarine. Cables 40 are incorporated with handling cable 16 through which the bell can be moved between a position at a distance from the extremity of the handling arm and a position close to the handling arm.

A description will now be provided of the release and then the recovery of a secondary underwater vehicle from a submarine when submerged using the device which will be described.

First of all a self-propelled secondary underwater vehicle 90 located in pressure resistant compartment 24 of storage caisson 26 is considered. It is assumed that this compartment is readied for release, i.e. it is filled with water and communicating door 25 is open. Secondary underwater vehicle 90 is then transported into open compartment 22 of the storage caisson using cradle 21. In this position the secondary underwater vehicle is seized by clamps 13 of immobilising device 12 and released from the securing means of cradle 21. When the immobilising device is a cage, the secondary underwater vehicle is simply slid into the cage. The handling arm is then manoeuvred to pass from storage position 18 to release position 19. In this release position 19 arm 9 extends above the submarine's fin and its extremity is outside the zone of turbulence. When the arm is in the release position, bow 91 of the secondary underwater vehicle is connected to docking bell 15. Clamps 13 of the immobilising device, when these are fitted to it, are then opened, and traction cable 16 of the docking bell is unwound to move the assembly comprising the secondary underwater vehicle and the docking bell away from the free extremity of handling arm 9. This movement is desirable so that the secondary underwater vehicle can be located in a zone which is not disturbed by handling arm 9. When the bell and the secondary underwater vehicle are sufficiently far from the free extremity of handling arm 9, the hook holding the bow of the secondary underwater vehicle is then moved into the release position and pump 32 is operated so as to inject water within the bell to push the secondary underwater vehicle away. When the secondary underwater vehicle is fully detached from the bell it is caused to move through its own means.

Once the secondary underwater vehicle has been released, the release and recovery device can be folded back and hidden within the fin and the raised deck of the submarine.

The operation of recovering a secondary underwater vehicle will now be described.

In order to recover a secondary underwater vehicle the release and recovery device is first deployed in such a way that arm 9 extends above fin 3 of the submarine and docking bell 15 is located at a sufficient distance from the free extremity of handling arm 9 for it to be located in a zone which is not disturbed by the turbulent flow around the submarine or the handling arm of the release and recovery device. In this position the release and recovery device is in a waiting position. Guide means comprising in particular acoustic transducer 31A and optical beam 31B are activated. The self-propelled secondary underwater vehicle then approaches the zone in which the docking bell is located. The guide means of the secondary underwater vehicle interact with the guide means of the docking bell and the secondary underwater vehicle is guided to approach the docking bell and dock with it. During this approach stage an operator may control the bell using control means 42, with the help of images provided by television camera 31C, to assist guidance of the secondary underwater vehicle. When the secondary underwater vehicle is very close to the docking bell, pump 32 of the docking bell is activated to pump out the water in the interior 33 of the bell to create negative pressure within it. This negative pressure makes it possible to position the bell correctly in relation to the bow of the secondary underwater vehicle. When the bow of the secondary underwater vehicle is well inserted into the bell, moving hook 36 is moved into hooking position 37 using its operating means 39. When the bow of the secondary underwater vehicle is well hooked within the bell, the bell is drawn in by cable 16 wound around winch 17 so as to bring the secondary underwater vehicle up to immobilising device 12. When the secondary underwater vehicle is located in contact with locking device 12, clamps 13 of the latter, when it is fitted with them, close to grip the secondary underwater vehicle. Arm 9 is then folded back in such a way as to bring the secondary underwater vehicle into storage compartment 20. When the secondary underwater vehicle is in this storage compartment the docking bell is uncoupled, the underwater vehicle being stored is engaged by cradle 21 located in the storage caissons and it is released by immobilising device 12. Then the secondary underwater vehicle is transferred from free zone 22 of the storage compartment to pressure resistant caisson 24. Separating door 25 is then closed again and water can be pumped into pressure resistant caisson 24.

All the movements of the release and recovery device are controlled by an operator from control station 41.

This device for release and recovery of a self-propelled secondary underwater vehicle has the advantage of being capable of being used when the submarine is submerged and under way, preferably at slow speed. It may be used to perform this manoeuvre several times in succession.

In the embodiment described the storage compartment comprises a free zone and a pressure resistant caisson. Those skilled in the art will however understand that other arrangements are possible.

Furthermore, in the example described the parent submarine comprises a raised deck and the storage compartment is located beneath the deck. But the storage compartment may also be located on the deck. In addition to this, the submarine may not have a deck. In this case the storage compartment may be located on the hull or within in.

Reversible docking means for the secondary underwater vehicle have been described in the form of a bell, but any other device which those skilled in the art may imagine may be used.

Finally, in the example described, the release or recovery zone is chosen in such a way that the arm is advantageously mounted on the top side of the fin, as a result of which benefit can be gained from the height of the latter. But other arrangements are possible. They require a handling arm which is sufficiently long for the release zone to be outside the zone of turbulence surrounding the submarine, and in particular far from the propeller.

The invention claimed is:

1. A submarine comprising:

a fin and a deck; and a device for release and recovery of a self-propelled secondary underwater vehicle, said device for release and recovery comprising, handling means for moving the secondary underwater vehicle between a storage zone and a release and recovery zone, and reversible docking means for releasing the secondary underwater vehicle at a time of release and for hooking the secondary underwater vehicle at a time of recovery, said reversible docking means being of one piece with said handling means, wherein said device for release and recovery is arranged so that the release and recovery zone is located outside a zone of turbulence surrounding the submarine when it is underway, and wherein the storage zone comprises a storage compartment comprising a caisson.

2. The submarine according to claim 1, wherein said device for release and recovery is mounted on an upper after extremity of said fin, and wherein said handling means is arranged to be placed in a resting position in which said handling means constitutes a trailing edge of said fin.

3. The submarine according to claim 2, wherein said handling means comprises a handling arm, one free extremity of which is movable between a storage position and a release and recovery position, and wherein said handling arm is mounted on a support on an after topside of said fin through an articulation which allows said handling arm to pivot about a transverse axis in relation to said handling arm.

4. The submarine according to claim 3, wherein said handling means comprises a gripping device for immobilizing the secondary underwater vehicle mounted on the free extremity of said handling arm, and means for maneuvering said handling arm and said gripping device.

5. The submarine according to claim 1, further comprising a raised deck, where said storage zone is located beneath said raised deck.

6. A submarine comprising:

a fin and a deck; and a device for release and recovery of a self-propelled secondary underwater vehicle, said device for release and recovery comprising, handling means for moving the secondary underwater vehicle between a storage zone and a release and recovery zone, and reversible docking means for releasing the secondary underwater vehicle at a time of release and for hooking the secondary underwater vehicle at a time of recovery, said reversible docking means being of one piece with said handling means, wherein said device for release and recovery is arranged so that the release and recovery zone is located outside a zone of turbulence surrounding the submarine when it is underway, and wherein said handling means comprises a handling arm, one free extremity of which is movable between a storage position and a release and recovery position, and wherein said handling arm is mounted on a support on an after topside of said fin through an articulation which allows said handling arm to pivot about a transverse axis in relation to said handling arm.

7. The submarine according to claim 6, wherein said handling means comprises a gripping device for immobilizing the secondary underwater vehicle mounted on the free extremity of said handling arm, and means for maneuvering said handling arm and said gripping device.

8. The submarine according to claim 7, wherein said immobilizing means is mounted at an extremity of said handling arm through means for controlling an orientation of an axis of the secondary underwater vehicle in at least a release position.

9. The submarine according to claim 7, wherein said immobilizing device comprises at least one of a clamp and a cage.

10. The submarine according to claim 9, wherein said immobilizing means is mounted at an extremity of said handling arm through means for controlling an orientation of an axis of the secondary underwater vehicle in at least a release position.

11. The submarine according to claim 6, wherein the storage zone comprises a storage compartment comprising a caisson.

12. A submarine comprising:

a fin and a deck; and a device for release and recovery of a self-propelled secondary underwater vehicle, said device for release and recovery comprising, handling means for moving the secondary underwater vehicle between a storage zone and a release and recovery zone, and reversible docking means for releasing the secondary underwater vehicle at a time of release and for hooking the secondary underwater vehicle at a time of recovery, said reversible docking means being of one piece with said handling means, wherein said device for release and recovery is arranged so that the release and recovery zone is located outside a zone of turbulence surrounding the submarine when it is underway, and wherein said reversible docking device comprises a docking bell comprising means for reversibly joining and locking said docking bell and a bow of the secondary underwater vehicle together, and means for guiding the secondary underwater vehicle.

13. The submarine according to claim 12, wherein said means for guiding comprises at least one of an acoustic transducer, optical beam, and laser beam.

14. The submarine according to claim 13, wherein said docking bell comprises a television camera and maneuvering means connected to a control station located within the submarine.

15. The submarine according to claim 12, wherein said handling means comprises a handling arm, one free extremity of which is movable between a storage position and a release and recovery position, wherein said docking bell is movable with respect to the one free extremity of said handling arm, and wherein said docking bell is connected to said handling arm by a cable wound around a winch.

16. The submarine according to claim 12, wherein said means for reversibly joining and locking comprises a pump through which water communicates with said docking bell.

17. The submarine according to claim 16, wherein said means for reversibly joining and locking comprises mechanical or magnetic locking means.

18. The submarine according to claim 12, wherein the storage zone comprises a storage compartment comprising a caisson.

* * * * *

UNITED STATES PATENT AND TRADEMARK OFFICE

CERTIFICATE OF CORRECTION

PATENT NO. : 8,186,295 B2
APPLICATION NO. : 12/665525
DATED : May 29, 2012
INVENTOR(S) : Jean-Claude Fournier It is certified that error appears in the above-identified patent and that said Letters Patent is hereby corrected as shown below:

On the title page, please amend Item (73) to read as follows:

--(73) Assignee: DCNS, Paris, (FR)--

Signed and Sealed this
Twenty-eighth Day of August, 2012

David J. Kappos

David J. Kappos
*Director of the United States Patent and Trademark Office*